US005495705A

United States Patent [19]

Miura et al.

[11] Patent Number: 5,495,705

[45] Date of Patent: Mar. 5, 1996

[54] PACKAGE MANUFACTURING METHOD

[75] Inventors: Hideo Miura; Yoshiaki Watanabe; Mitsuhiro Sumimoto, all of Tokyo, Japan

[73] Assignees: Sankyo Company, Limited; Dai Nippon Printing Co., Ltd., both of Japan

[21] Appl. No.: 193,194

[22] PCT Filed: Jun. 16, 1993

[86] PCT No.: PCT/JP93/00809

§ 371 Date: Apr. 5, 1994

§ 102(e) Date: Apr. 5, 1994

[87] PCT Pub. No.: WO93/25451

PCT Pub. Date: Dec. 23, 1993

[30] Foreign Application Priority Data

Jun. 16, 1992 [JP] Japan ..... 4-183048

[51] Int. Cl.[6] ..... B65B 5/02; B65B 47/04; B65B 61/00

[52] U.S. Cl. ..... 53/411; 53/449; 53/453

[58] Field of Search ..... 53/411, 449, 452, 53/453, 140, 141, 175, 558, 559; 264/81, 241, 297.5

[56] References Cited

U.S. PATENT DOCUMENTS

| | | | |
|---|---|---|---|
| 1,538,277 | 5/1925 | Dula | 53/449 X |
| 1,692,822 | 11/1928 | Eckstein | 53/449 X |
| 2,872,760 | 2/1959 | Meissner | 53/449 X |
| 2,970,414 | 2/1961 | Rohdin | 53/453 |
| 3,488,911 | 1/1970 | Poupitch | 53/449 X |
| 3,503,493 | 3/1970 | Nagy | 53/449 X |
| 3,648,834 | 3/1972 | Gifford et al. | 53/449 X |
| 4,223,512 | 9/1980 | Buchner | 53/453 X |
| 4,224,779 | 9/1980 | Guedet | 53/453 X |
| 4,945,708 | 8/1990 | Curiel | 53/141 X |

FOREIGN PATENT DOCUMENTS

| | | |
|---|---|---|
| 59-26466 | 2/1984 | Japan . |
| 60-6452 | 1/1985 | Japan . |
| 61-32134 | 7/1986 | Japan . |
| 61-55864 | 11/1986 | Japan . |
| 3-9753 | 1/1991 | Japan . |

*Primary Examiner*—Horace M. Culver
*Attorney, Agent, or Firm*—Parkhurst Wendel & Rossi

[57] ABSTRACT

A package is formed of a molded sheet (1) of a thermoplastic synthetic resin having a plurality of pocket-shaped molded portions (2) formed in one surface thereof, with an object (T) to be packaged accommodated in each of the pocket-shaped molded portions; and a sealing sheet is bonded to the other surface of the molded sheet so as to seal off openings of the pocket-shaped molded portions. A deposit layer (4) of an inorganic oxide such as a silicon oxide is formed on one or both of the inner and outer surfaces of each pocket-shaped molded portion (2). The deposit layer (4) compensates for thinning of a top wall (2*a*) and peripheral edge (2*c*) of the pocket-shaped molded portion (2), caused by the molding process, to increase the barrier capability thereof.

7 Claims, 12 Drawing Sheets

PACKAGE MANUFACTURING METHOD

TECHNICAL FIELD

The present invention relates to a package for objects that ought to be protected from moisture and gas permeation, such as pharmaceuticals, foodstuffs, cosmetics, in tablet, capsule, liquid, cream, or ointment form, and a method of manufacturing such a package.

BACKGROUND ART

A package called a Press Through Pack (PTP) is widely known as packaging for accommodating pharmaceuticals in the form of a plurality of tablets or capsules. A PTP, as will be described later in detail, is configured of a molded sheet formed of a thermoplastic synthetic resin having on one surface thereof a plurality of pocket-shaped molded portions, and a sealing sheet connected to the other surface of the molded sheet in such a manner that it closes off the openings of the pocket-shaped molded portions and protects a pharmaceutical accommodated within each of the pocket-shaped molded portions from the outer atmosphere.

A material such as a polyvinyl chloride resin, polypropylene resin, or polyethylene resin is used as the thermoplastic synthetic resin material that forms the molded sheet of this type of PTP, and aluminum foil coated with a heat-sealing agent or laminated with a heat-sealing film is typically used as the material of the sealing sheet.

In such a PTP, the water vapor and gas permeability of the molded sheet of a synthetic resin affects the stability of the object to be packaged, such as a pharmaceutical. Therefore, if a PTP is used to package an object that is readily affected by water vapor and gases, a layer of polyvinylidene chloride, which has an excellent barrier capability, is laminated over the molded sheet, in order to provide an even greater barrier effect.

Thus, a method of increasing the barrier capabilities of the molded sheet having pocket-shaped molded portions by laminating another layer over it has been proposed, but it is inevitably expensive and, in addition, unexpected problems have been cited as described below. The pocket-shaped molded portions of the molded sheet protrude out of one surface of that sheet and have a peripheral wall and a top wall, and the space therewithin opens outward into the other surface thereof, but the mold used during the molding processing stretches the material of a pocket-shaped molded portion of this type, which causes the top wall and also the peripheral edge between the top wall and the peripheral wall to thin. Since the pocket-shaped molded portions are inherently thinned locally by the molding processing, it is inevitable that there will remain some thinner portions in the top wall and peripheral edge after the molding operation, even if the barrier capabilities are increased by laminating a layer of polyvinylidene chloride thereover. Therefore, thickening the molded sheet by laminating it will not increase the barrier capability by much, but it will increase the cost and it will also increase the thickness of the molded sheet away from the pocket-shaped molded portions, where it is not necessary to have a barrier capability, while making it more difficult to push the packaged object out from within the pocket-shaped molded portions by a finger.

In addition, if the above polyvinylidene chloride layer with its high barrier capability is used as a partial laminate sheet, the inherently brittle polyvinylidene chloride will be unable to accommodate stretching of the material due to the molding processing, and fine cracks may occur. If cracking of this sort occurs, the barrier capabilities will deteriorate.

Further, although polyvinylidene chloride has excellent barrier capabilities, it is liable to discolor, so that, if the molded sheet is transparent, the discoloration can be seen from the outside in an unpleasant manner. In addition, when the molded sheet and the sealing sheet are heat-sealed together to form the package, there is a problem that bubbles are likely to occur.

It has been considered to apply the polyvinylidene chloride by coating instead of lamination, but, in this case too, problems similar to those described above occur. Further, it has been considered to use a fluorine-based resin as the laminate layer, but, in the same way as polyvinylidene chloride, a fluorocarbon resin cannot be said to be a good material from the viewpoint of protecting the Earth's environment and from recycling and incineration viewpoints. For example, although polyvinylidene chloride is considered to be preferable from the viewpoint of barrier capability, it emits chlorine when it is incinerated and thus it is particularly unfavorable from the viewpoint of environmental protection.

Alternatively, instead of increasing the protective capabilities of the molded sheet having pocket-shaped molded portions itself, a number of PTPs could be collected together and further packaged in a flexible packaging material containing aluminum foil. Packaging of this sort is usually called "pillow packaging" and PTPs that implement pillow packaging are further accommodated in boxes, and these have been put on the market. However, in this case, there are problems in that the packaged object cannot be seen, and also a much larger amount of packaging material is used overall, so the amount of useless waste increases and the dimensions of the outer box are also large. Packaging that uses pillow packaging takes up approximately 25% more space than packaging that doesn't use pillow packaging. The larger size of the overall package is a problem in that it makes it inconvenient from the point of view of transportation and storage.

The present invention was intended to solve the above described problems and has as its objective the provision of a novel type of packaging that is moisture-proof and has superior gas-barrier capabilities, and can moreover reduce the volume of packaging to make the above pillow packaging unnecessary, and also present few environmental pollution problems after disposal.

Another objective of the present invention is to provide a new method of manufacturing the above packaging.

DISCLOSURE OF THE INVENTION

The package according to the present invention comprises: a sheet molded from a thermoplastic synthetic resin that is provided with at least one pocket-shaped molded portion formed in a protuberant state on one surface thereof, with an opening of the pocket-shaped molded portion on the other side thereof; a object to be packaged that is accommodated within the pocket-shaped molded portion; a sealing sheet bonded to the other surface of the molded sheet in such a manner as to seal the opening of the pocket-shaped molded portion; and a deposit layer which has moisture-proofing and gas barrier capabilities and which is provided over at least one of the inner and outer surfaces of the pocket-shaped molded portion in such a manner as to seal that surface or surfaces.

According to the present invention, there is also provided a method of manufacturing the above package. This method of manufacturing a package comprises the steps of: preparing a thermoplastic synthetic resin sheet, forming at least one pocket-shaped molded portion in the thermoplastic synthetic resin sheet in such a manner that it protrudes from one surface thereof, and at the same time forming an opening for the pocket-shaped molded portion in the other surface of the thermoplastic synthetic resin sheet, to obtain a molded sheet; forming a deposit layer over at least one of inner and outer surfaces of the pocket-shaped molded portion formed as above; accommodating an object to be packaged within the pocket-shaped molded portion; and bonding a sealing sheet to the other surface of the molded sheet in such a manner as to seal the opening of the pocket-shaped molded portion.

The package of the present invention removes the need to use expensive means of laminating the molded sheet, and can increase the barrier capability of the package by a comparatively inexpensive means of using a deposit layer to reinforce thinner portions, mainly in the pocket-shaped molded portions, of the package.

Since the method of manufacturing of the present invention forms a deposit layer after pocket-shaped molded portions have been formed in a molded sheet, it is effective in reinforcing thinner portions and can thus provide a package with an increased barrier capability.

Note that, within this specification, "deposit layer" means a layer that is formed by chemical vapor deposition or physical vapor deposition, or by a similar process.

BEST MODES FOR CARRYING OUT THE INVENTION

Embodiments of the present invention will now be described in detail with reference to the accompanying drawings.

Figure 1:
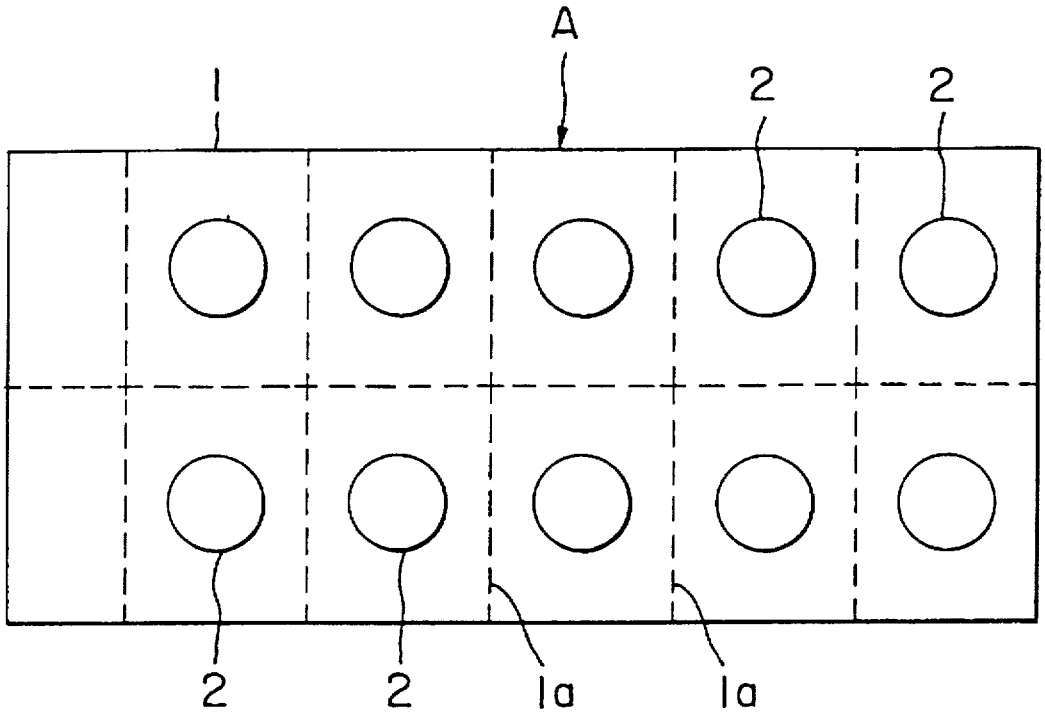
FIG. 1 is a plan view of the packaging of the present invention.
Figure 2:
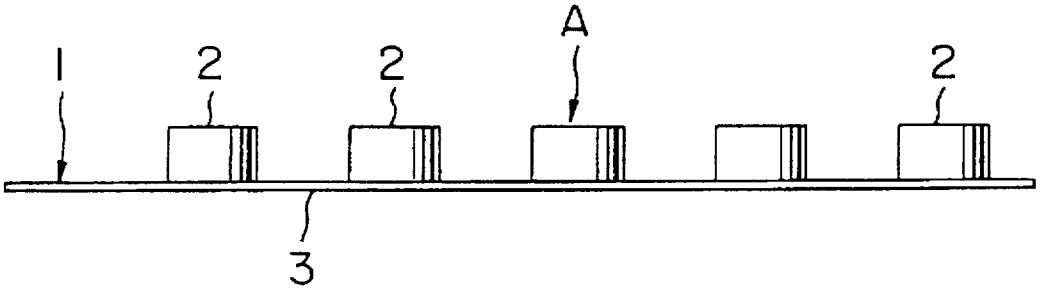
FIG. 2 is a side view of the packaging of FIG. 1.
Figure 3:
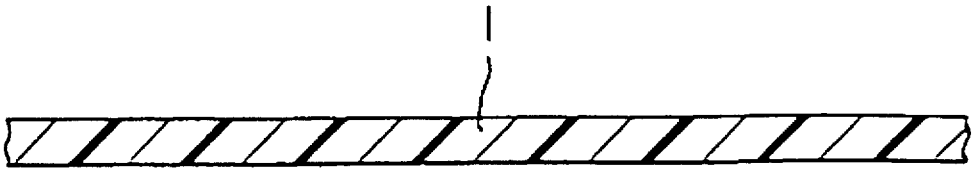
FIG. 3 is an enlarged partial cross sectional view of the material of the molded sheet.

A package A according to the present invention is shown in FIG. 1 and FIG. 2. This package A is a Press Through Pack (PTP) that is provided with a molded sheet 1 of a thermoplastic synthetic resin wherein a number of pocket-shaped molded portions (PTP molded portions) 2 are formed so as to protrude from one side surface, as is known in the art. The molded sheet 1 of thermoplastic synthetic resin has a flat shape before it is molded, as shown in FIG. 3, and the pocket-shaped molded portions 2 are formed by being molded over a molding die as indicated in FIG. 4.

Each of the pocket-shaped molded portions 2 is provided with a top wall **2*a* and a peripheral wall 2*b*, with an angled peripheral edge 2*c* formed between these two walls. As described above, the top wall 2*a* and the peripheral edge 2*c* are inevitably thinned during their fabrication by stretching of the material thereof. This means that the thickness of the top wall 2*a* is half or less of that of the initial thickness of the sheet, and that of the peripheral edge 2*c*** is a third or less of that thickness.

In accordance with the present invention, after the pocket-shaped molded portions 2 have been formed as described above, a deposit layer that has moisture-proofing and gas barrier capabilities is applied over the entire region of at least one of the inner and outer surfaces of each pocket-shaped molded portion 2, or in such a manner as to cover the entire surface of the molded sheet 1.

Figure 4:
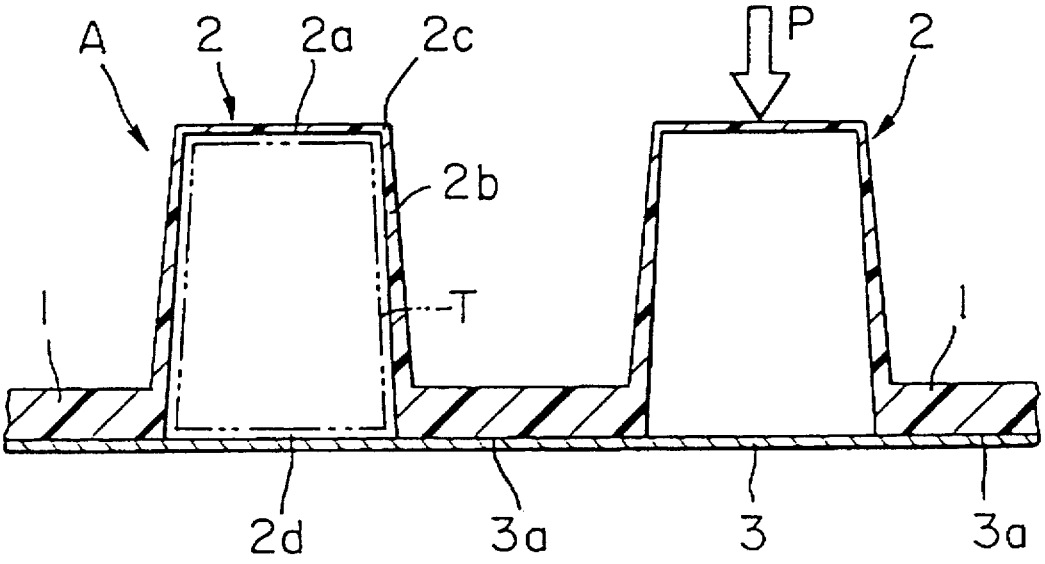
FIG. 4 is an enlarged cross sectional view of part of FIG. 2.

As shown in FIG. 4, each of the pocket-shaped molded portions 2 has an opening **2*d* that opens in the back surface of the molded sheet 1, opposite to the surface from which the pocket-shaped molded portion 2 protrudes, and an object T to be packaged is put within the empty interior of the pocket-shaped molded portion 2 through the opening 2*d***. The object T to be packaged could be a pharmaceutical in tablet or capsule form, or a foodstuff, or a cosmetic.

In this manner, after the object T to be packaged is accommodated in the pocket-shaped molded portion 2, a sealing sheet 3 of a foil form is bonded by a method such as heat sealing to the back surface of the molded sheet 1 so as to seal it, and hermetically seal the object T to be packaged from the outer atmosphere. In FIG. 4, reference number **3*a*** denotes a bond surface formed by heat sealing.

Thus the package A shown in FIG. 1 and FIG. 2 is obtained. Note that, as shown in FIG. 1, tear-off perforations **1*a*** of a known type are formed in such a manner that the package A can be divided into individual packages.

To remove the object T to be packaged from the PTP package A in which it is sealed, the top wall **2*a* of the pocket-shaped molded portion 2 is pressed inward by a finger in the direction of the arrow as shown in FIG. 4. This collapses the pocket-shaped molded portion 2 so that the object T to be packaged therewithin is pushed to the outside while rupturing the sealing sheet 3 over the opening 2*d***.

Polyethylene terephthalate, polypropylene, or a similar environmentally friendly resin sheet is used as the above thermoplastic synthetic resin, but a polyvinyl chloride resin sheet or a multi-layer material including such a resin could be used instead. The thickness of the molded sheet 1 is of the order of 200 to 300 μm.

The sealing sheet 3 is typically formed of aluminum foil of a thickness of about 20 μm and, since it is to form a heat seal with the molded sheet 1, a known heat sealant is coated over the surface thereof.

As previously described, a deposit layer having vapor-proofing and gas barrier capabilities is formed over the entire, surface of at least one of the inner and outer surfaces of the pocket-shaped molded portion 2 in accordance with the present invention. The material of the deposit layer is preferably an inorganic oxide such as a silicon oxide (SiOx), aluminum oxide ($Al_2O_3$), stannic oxide ($SnO_2$); but is more preferably a silicon oxide (SiOx) (hereinafter abbreviated to "silica"). This layer is deposited on the inner and/or outer surfaces of the pocket-shaped molded portion 2 by a method such as chemical vapor deposition (CVD). Than forming the deposit layer only on the inner and outer surfaces of the pocket-shaped molded portion 2, it is easier to form the deposit layer over the entire inner and outer surfaces of the molded sheet 1 that includes the pocket-shaped molded portion 2, which makes this method more practicable.

Note that, as already defined, a "deposit layer" means a layer that can be deposited by chemical vapor deposition, physical vapor deposition, or any similar method.

Figure 5:
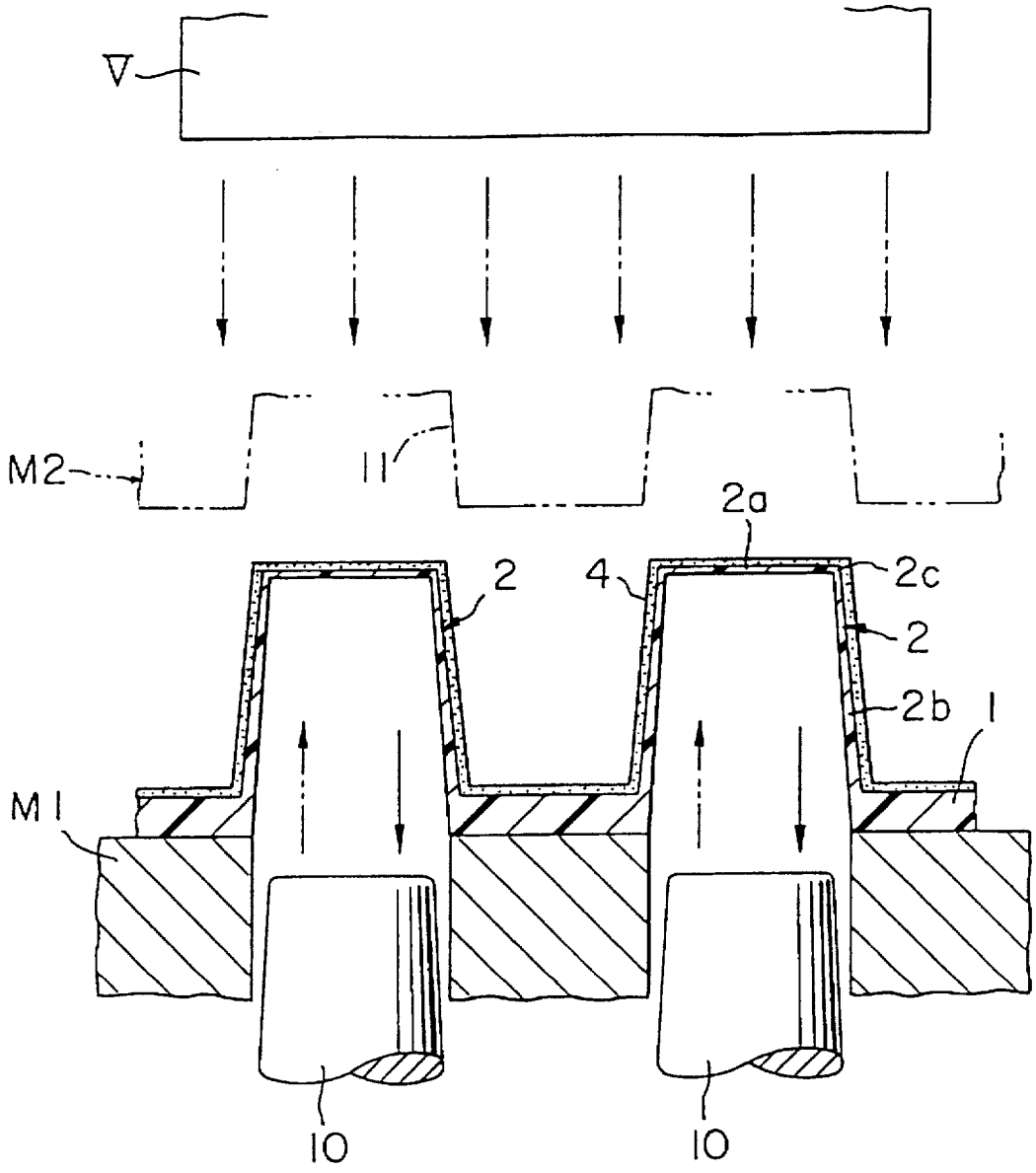
FIG. 5 is a view illustrative of the molding of the molded sheet and the deposit layer formation.

The state of a synthetic resin molded sheet 1 after it has been molded by molds M1 and M2 is shown in FIG. 5. If a known plug-assisted vacuum forming method is used, the synthetic resin molded sheet 1 is inserted between the molds M1 and M2, the two molds M1 and M2 are brought closer to each other to sandwich the sheet 1 therebetween, plugs 10 are poked upward in this figure from below, and thus pocket-shaped molded portions 2 are formed between the plugs 10 and female concavities 11 in the mold M2. Thereafter, the two molds are separated and the plugs 10 retreat. During this molding process, heat is applied to the sheet 1 to facilitate the molding. The molds are moved by a pneumatic motive means. Note that other methods could be used to mold the sheet 1, such as a vacuum forming method.

After the sheet 1 has been molded in this manner, a process such as deposition can be applied with the sheet 1 still attached to the mold M1. Fine particles such as silica generated from a metal oxide source material V are projected under the vacuum toward the molded sheet 1, as shown by the broken lines in the figure, and attach thereto to form a deposit layer 4. Before and during this deposit layer formation process, a cooling medium or liquid is circulated through the interior of the mold M1 to cool the mold itself and the molded sheet 1. This can prevent defects from occurring in the deposit layer while the deposit layer 4 is being formed, which are otherwise likely to occur while the heat-molded sheet 1 is deforming on cooling.

For example, when silica is deposited by plasma deposition on a sheet molded of polyethylene terephthalate, organosiloxane is used as the processing source material. This ensures that no holes occur in the silica layer deposited on the surface of the molded sheet, caused by splashing of by-products, and the speed of the deposition processing line can be increased. With plasma deposition, the silica is volatilized in a vacuum and is deposited on the surface of the polyethylene terephthalate resin sheet, and forms stable molecules. A silica deposition film is colorless, transparent, has sufficient barrier capabilities, and is strongly adhesive. This plasma deposition can also be used for application on a molded sheet of polypropylene. Alternatively, a silica layer could be formed by an ion plating method or an electron beam method.

Since the silica that is most suitable for use in the deposit layer is a naturally occurring chemical compound, it has little likelihood of causing environmental pollution after the package has been used, and therefore it can be said to be extremely suitable as a constitutional element of the package.

As shown in FIG. 5, deposition processing in which the top wall 2*a* of each pocket-shaped molded portion 2 of the molded sheet 1 is orientated towards the processing source material is extremely suitable. Since particles generated from a metal oxide source material are more likely to deposit heavily on the top wall 2*a* that is closest thereto, this naturally forms a thicker deposit layer 4 over the top wall 2*a* and peripheral edge 2*c* than on the peripheral wall 2*b*. Therefore, since the top wall 2*a* and peripheral edge 2*c*, which ended up the thinnest portions after the molding, are covered by a thicker deposit layer 4, the barrier capabilities of these portions are reinforced, and this has the effect of increasing the barrier capability of the entire pocket-shaped molded portion 2.

As described above, by forming a deposit layer on at least one of the surfaces inside and outside of the pocket-shaped molded portion of the molded sheet, not only can it be implemented comparatively inexpensively, but also it has the huge effect of increasing barrier capability.

In contrast, experiments into increasing barrier capability by laminating the molded sheet itself, as already mentioned, have not yet proved conclusive. An example of this method is shown in FIG. 22 and FIG. 23.

Figure 22:
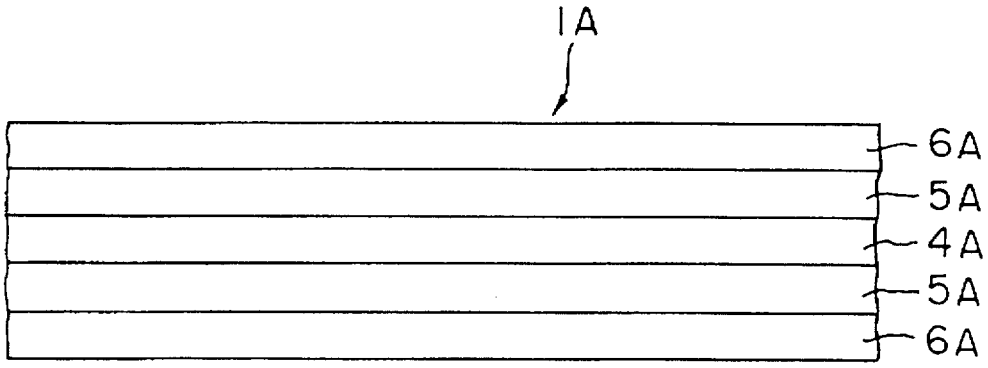
FIG. 22 is an enlarged cross sectional view of an ordinary laminated composite sheet of high barrier capabilities.

FIG. 22 shows an example of an ordinary laminate composite sheet 1A of high barrier capabilities, configured such that a polyvinylidene chloride film 5A is formed on each side of a polyethylene film 4A, and then a film 6A is laminated onto each outer surface of the polyvinylidene chloride films 5A.

Figure 23:
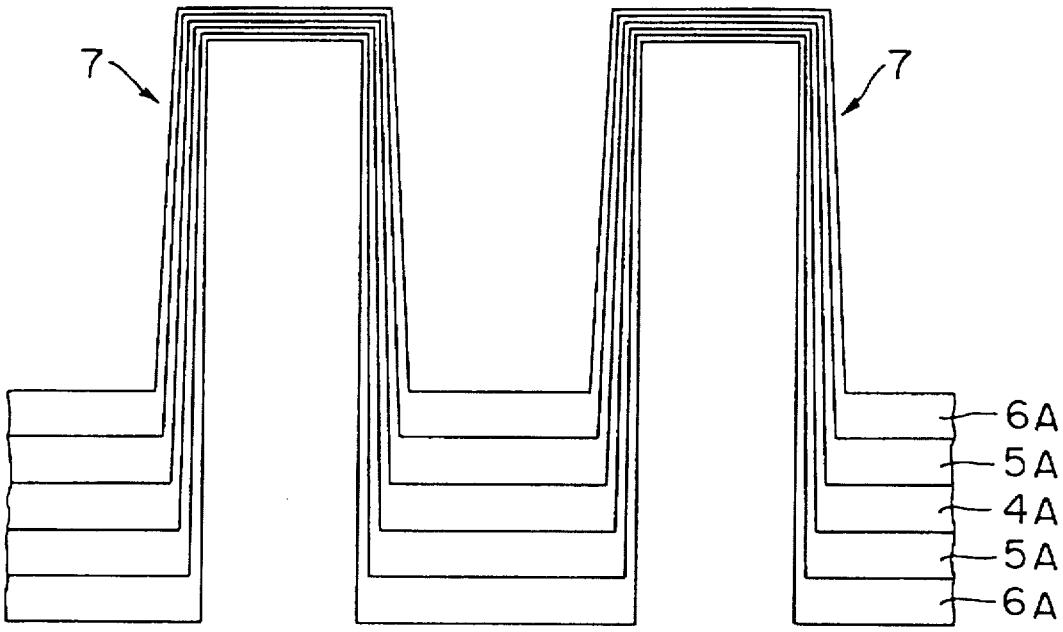
FIG. 23 is an enlarged cross sectional view of pocket-shaped molded portions molded from the composite sheet of FIG. 22.

FIG. 23 shows a cross section through pocket-shaped molded portions 7 of a molded sheet that has been molded by ordinary means from this composite sheet 1A. As can be seen from FIG. 23, the thickness of a top wall portion and angled peripheral portion of each pocket-shaped molded portion 7 is reduced as expected, in the same way as in a sheet that is not laminated, and thus the thickness of the functional material, such as a moisture-proof material, is also dramatically reduced. In this state, it is difficult to utilize the characteristics and functions innate to such materials, so that even if an expensive, efficient material is used, it is clear that limitations will placed on its barrier effect.

Figure 6:
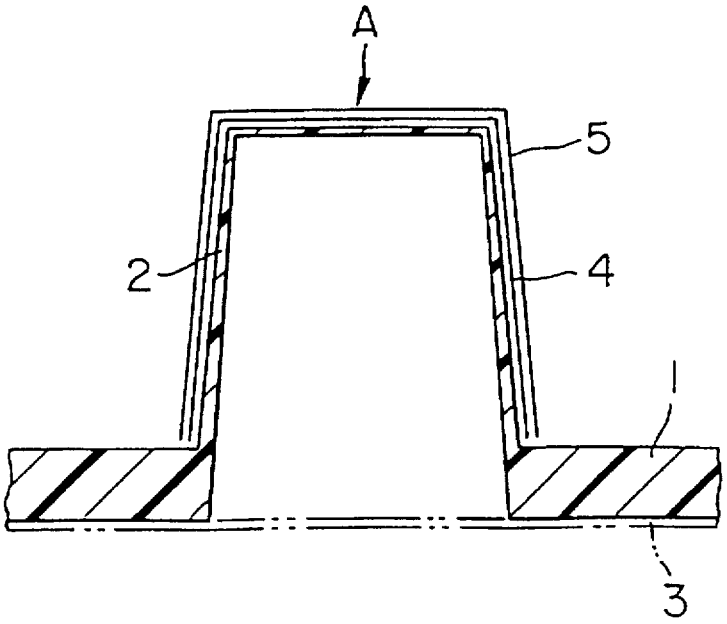
FIG. 6 is an enlarged cross sectional partial view of one form of the deposit layer applied to the molded sheet and a pocket-shaped molded portion.
Figure 7:
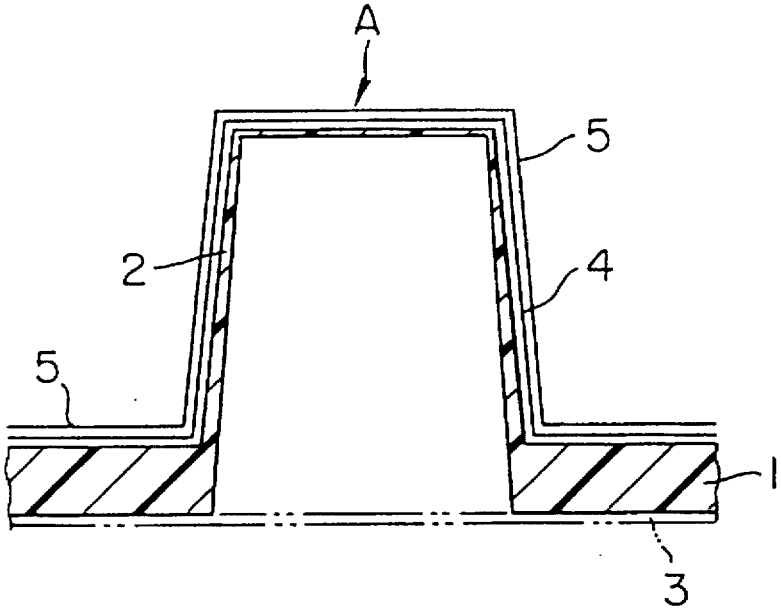
FIG. 7 to FIG. 21 are each an enlarged cross sectional partial view of another form of the deposit layer applied to the molded sheet and a pocket-shaped molded portion.

The description will now turn to basic embodiments of the package of the present invention, shown in FIG. 6 and FIG. 7. In FIG. 6, a deposit layer 4 having moisture-proofing and gas barrier capabilities is formed over the entire outer surface region of each pocket-shaped molded portion 2 of this embodiment. If necessary, a protective film 5 may also be formed to cover the entire outer surface region of the deposit layer 4. An ultraviolet-hardening resin such as an acrylic resin is most suitable as the protective film 5. The thickness of the deposit layer 4 need be no more than 1000 Angstroms, and thicknesses within a range of 400 to 800 Angstroms can be used.

In the embodiment shown in FIG. 7, the deposit layer 4 is formed by the same means as described above over the entire outer surface region of the thermoplastic synthetic resin molded sheet 1, including the pocket-shaped molded portions 2, and then the protective film 5 is formed by the same means as described above over the entire outer surface region of the deposit layer 4.

Figure 8:
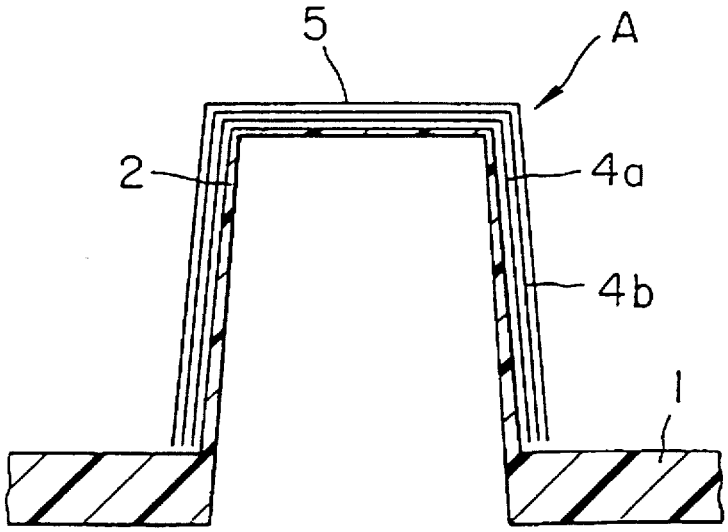
Figure 9:
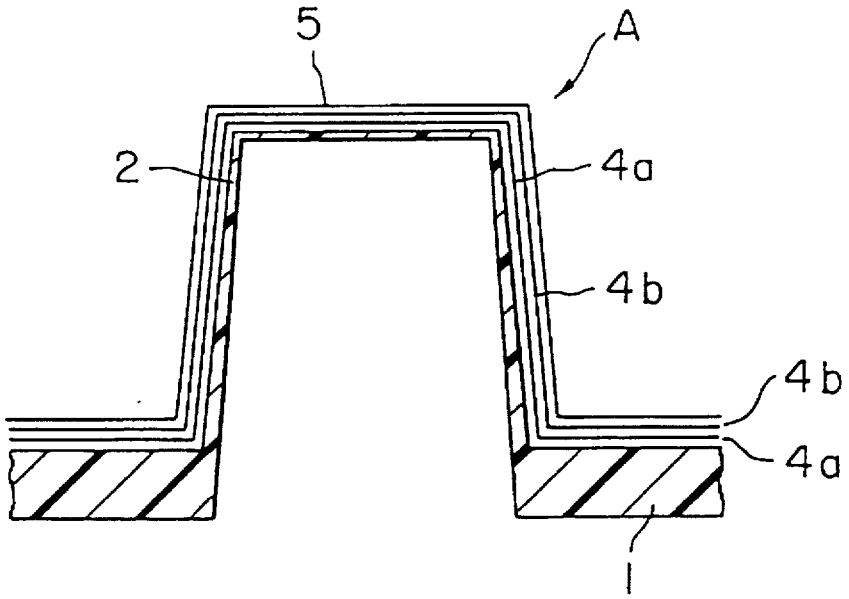

Further embodiments of the present invention will now be described with reference to FIG. 8 and FIG. 9. In the embodiment of FIG. 8, two deposit layers 4*a* and 4*b* are formed in turn by the same means as described above over the entire outer surface region of each of the molded pocket-shaped molded portions 2, and then the protective film 5 is formed by the same means as described above over the entire outer surface region of the outer deposit layer 4*b*. In the embodiment of FIG. 9, two deposit layers 4*a* and 4*b* are formed in turn by the same means as described above over the entire outer surface region of the thermoplastic synthetic resin molded sheet 1, including the pocket-shaped molded portions 2, and also the protective film 5 is formed by the same means as described above over the entire outer surface region of the outer deposit layer 4*b*.

Figure 10:
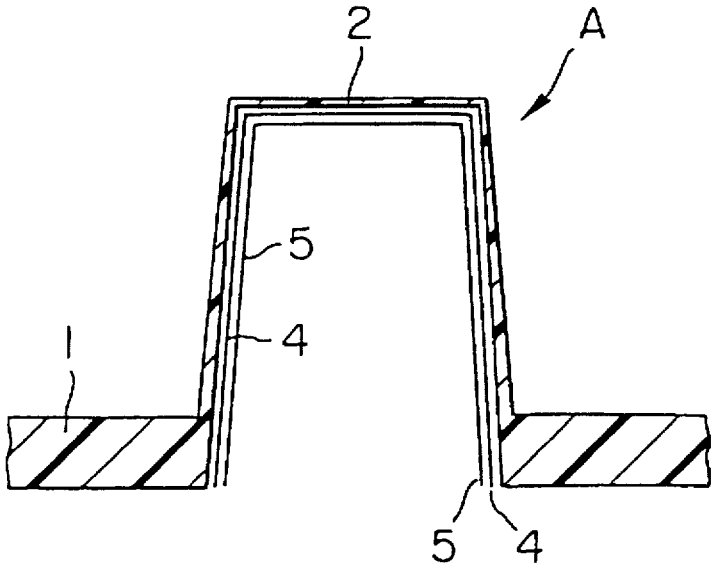
Figure 11:
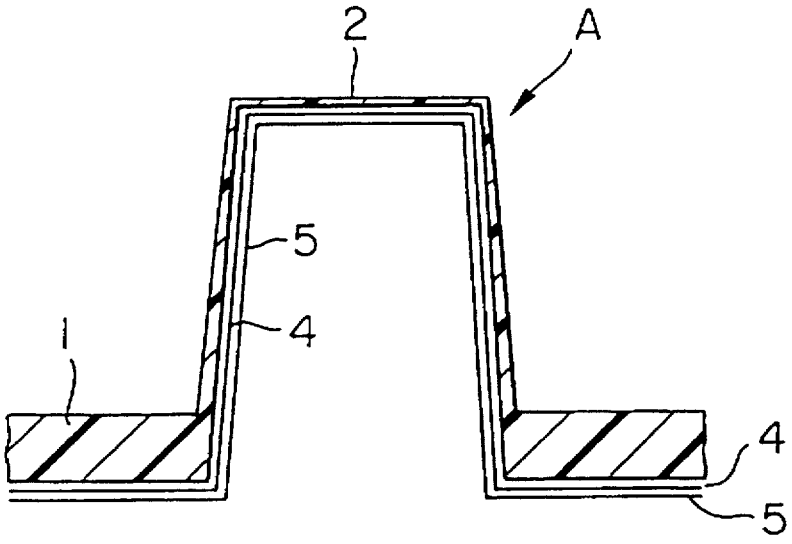

Yet further embodiments of the present invention will now be described with reference to FIG. 10 and FIG. 11. In the embodiment shown in FIG. 10, the deposit layer 4 is formed by the same means as described above over the entire inner surface region of each molded pocket-shaped molded portion 2, then the protective film 5 is formed by the same means as described above over the entire inner surface region of the deposit layer 4. In the embodiment of FIG. 11, the deposit layer 4 is formed by the same means as described above over the entire inner surface region of the thermoplastic synthetic resin molded sheet 1, including the pocket-shaped molded portions 2, and then the protective film 5 is formed by the same means as described above over the entire inner surface region of the deposit layer 4.

Figure 12:
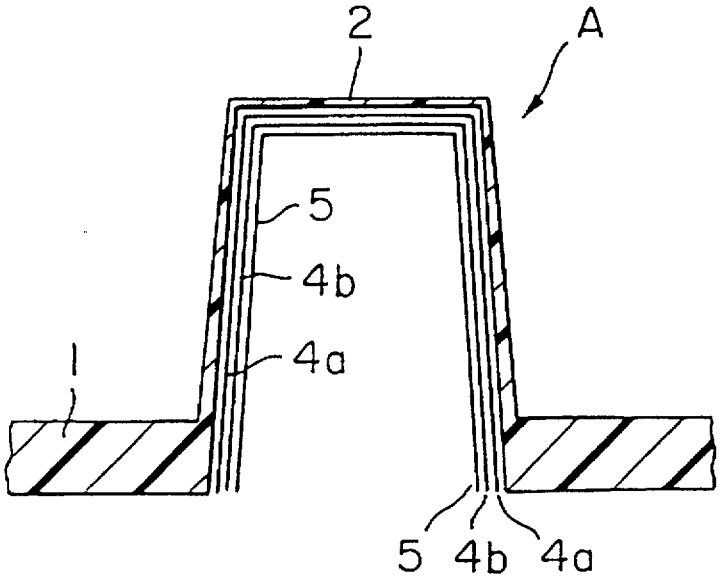
Figure 13:
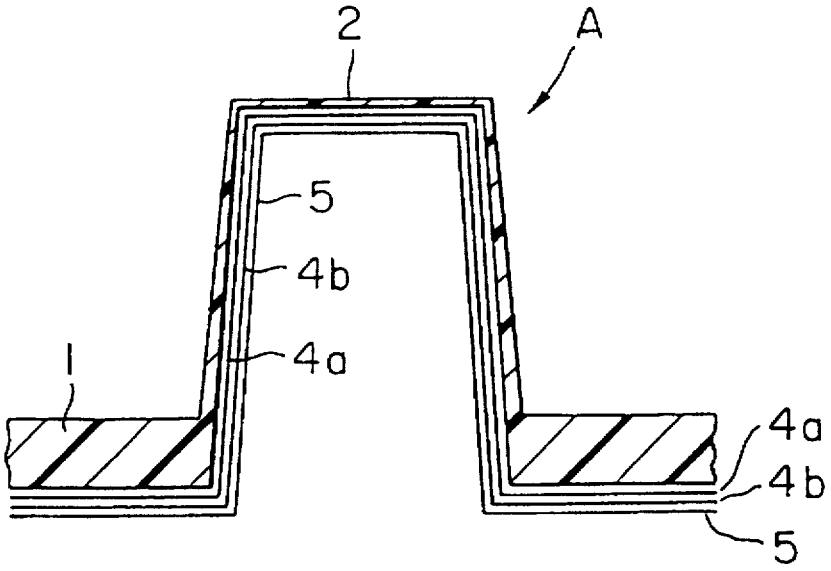

Even further embodiments of the present invention will now be described with reference to FIG. 12 and FIG. 13. In the embodiment shown in FIG. 12, two deposit layers 4*a* and 4*b* are formed in turn by the same means as described above over the entire inner surface region of each of the molded pocket-shaped molded portions 2, and then the protective film 5 is formed by the same means as described above over the entire inner surface region of the inner deposit layer 4*b*. In the embodiment shown in FIG. 13, two deposit layers 4*a* and 4*b* are formed in turn by the same means as described above over the entire inner surface region of the thermoplastic synthetic resin molded sheet 1, including the pocket-shaped molded portions 2, and then the protective film 5 is formed by the same means as described above over the entire inner surface region of the inner deposit layer 4*b*.

In the embodiments shown in the above described FIGS. 6 to 13, a deposit layer is formed over the entire region of at least one of the inner and outer surface of each pocket-shaped molded portion 2, and a protective film is formed to cover it if necessary, but the deposit layer and protective film could be formed over the entire regions of both the inner and outer surfaces of each pocket-shaped molded portion 2, as described below.

Figure 14:
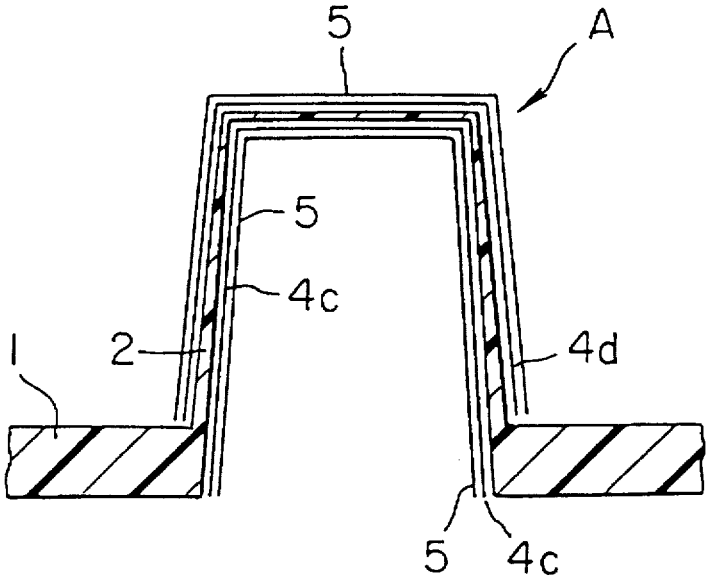
Figure 15:
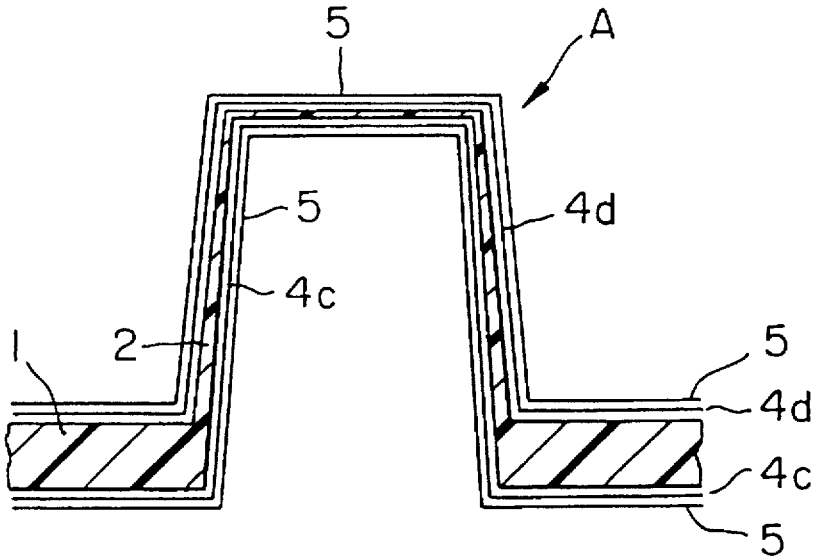
Figure 16:
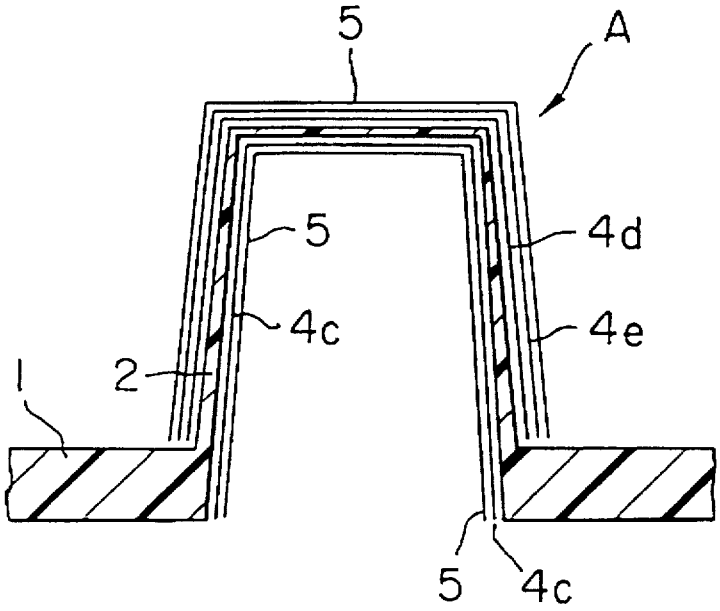

Two such embodiments are shown in FIG. 15 and FIG. 16. The embodiment shown in FIG. 14 combines the configurations of FIG. 6 and FIG. 10. In other words, deposit layers 4*c* and 4*d* are respectively formed by the same means as described above over the entire inner and outer surface regions of each pocket-shaped molded portion 2, and then protective films 5 are formed by the same means as described above over the entire inner and outer surface regions of the thus-formed layers 4*c* and 4*d*. The embodiment shown in FIG. 15 combines the configurations of FIG. 7 and FIG. 11. In other words, deposit layers 4*c* and 4*d* are respectively formed by the same means as described above over the entire inner and outer surface regions of the thermoplastic synthetic resin molded sheet 1, including the pocket-shaped molded portions 2, and then protective films 5 are formed by the same means as described above over the entire inner and outer surface regions of the thus-formed layers 4*c* and 4*d*.

Figure 17:
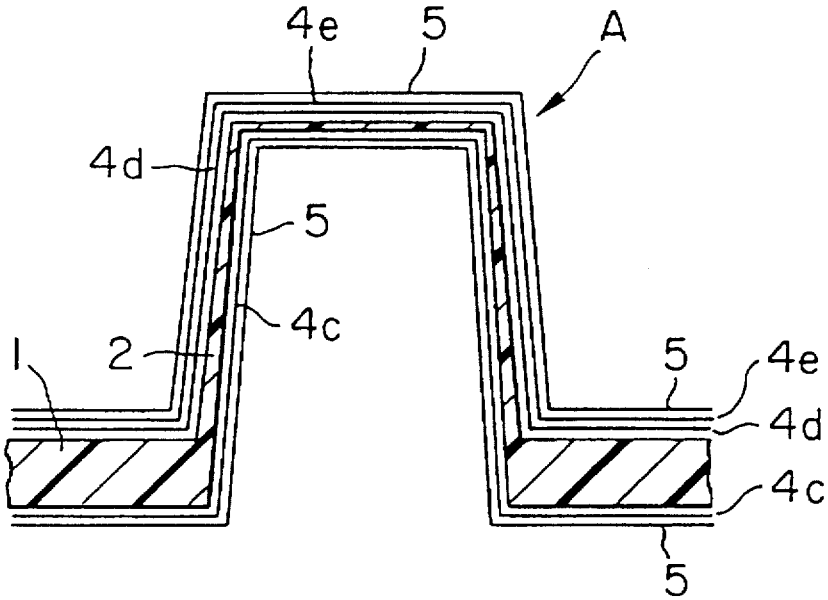

Further embodiments will now be described with reference to FIG. 16 and FIG. 17. The embodiment shown in FIG. 16 combines the configurations of FIG. 8 and FIG. 10. In other words, deposit layers 4*c* and 4*d* are respectively formed by the same means as described above over the entire inner and outer surface regions of each pocket-shaped molded portion 2, a further deposit layer 4*e* is formed over the entire outer surface region of the deposit layer 4*d* on the outer surface, and then protective films 5 are formed by the same means as described above over the entire outer surface region of the deposit layer 4*e* and the entire inner surface region of the deposit layer 4*c* on the inner surface. Similarly, the embodiment shown in FIG. 17 combines the configurations of FIG. 9 and FIG. 11. In other words, deposit layers 4*c* and 4*d* are respectively formed by the same means as described above over the entire inner and outer surface regions of the thermoplastic synthetic resin molded sheet 1, including the pocket-shaped molded portions 2, a further deposit layer 4*e* is formed over the outer surface of the deposit layer 4*d* on the outer surface, and then protective films 5 are formed by the same means as described above over the outer surface of the deposit layer 4*e* and the entire inner surface region of the deposit layer 4*c* on the inner surface.

Figure 18:
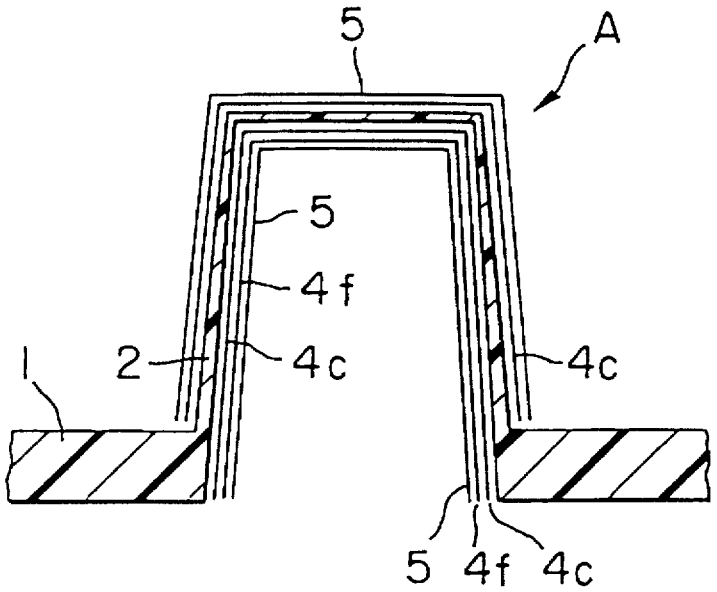
Figure 19:
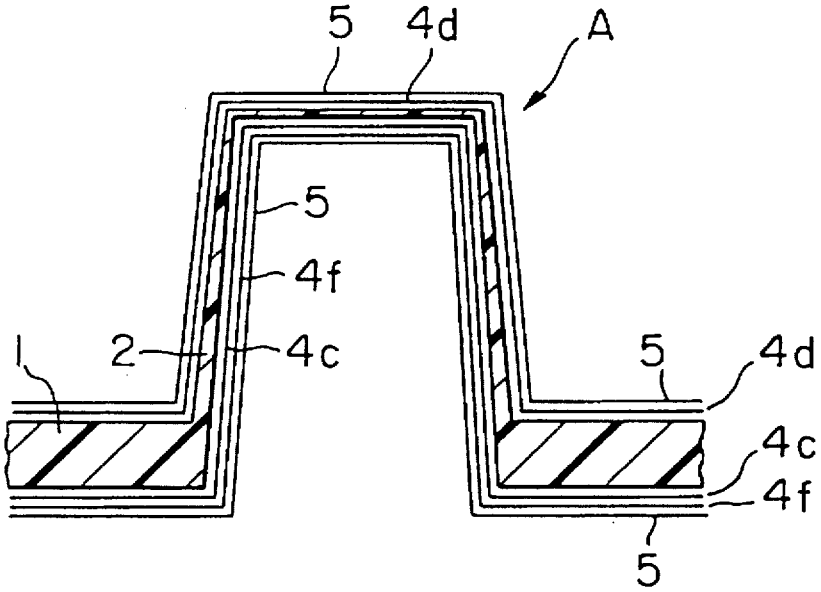

Yet further embodiments will now be described with reference to FIG. 18 and FIG. 19. The embodiment shown in FIG. 18 combines the configurations of FIG. 6 and FIG. 12. In other words, deposit layers 4*c* and 4*d* are respectively formed by the same means as described above over the entire inner and outer surface regions of each pocket-shaped molded portion 2, a further deposit layer 4*f* is formed over the entire inner surface region of the deposit layer 4*c* on the inner surface, and then protective films 5 are formed by the same means as described above over the inner surface of the deposit layer 4*f* and the outer surface of the deposit layer 4*d* on the outer surface. Similarly, the embodiment shown in FIG. 19 combines the configurations of FIG. 7 and FIG. 13. In other words, deposit layers 4*c* and 4*d* are respectively formed by the same means as described above over the entire inner and outer surface regions of the thermoplastic synthetic resin molded sheet 1, including the pocket-shaped molded portions 2, a further deposit layer 4*f* is formed over the entire inner surface region of the deposit layer 4*c* on the inner surface, and then protective films 5 are formed by the same means as described above over the entire inner surface of the deposit layer 4*f* and the entire outer surface region of the deposit layer 4*d* on the outer surface.

Figure 20:
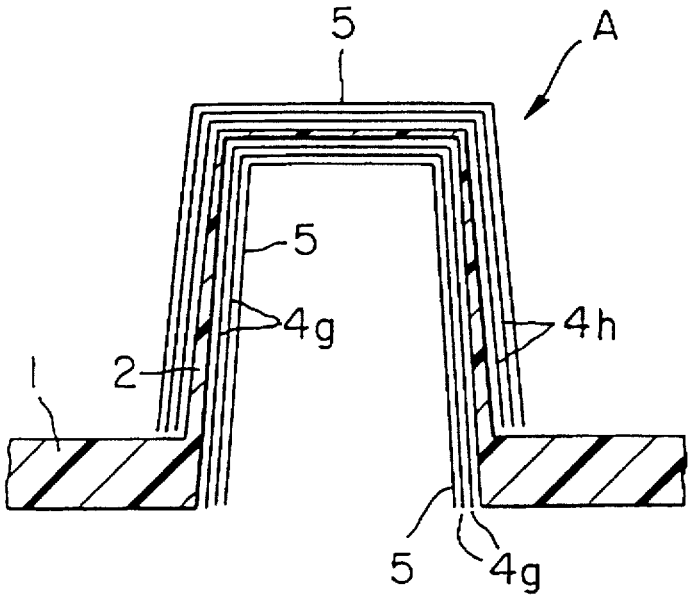
Figure 21:
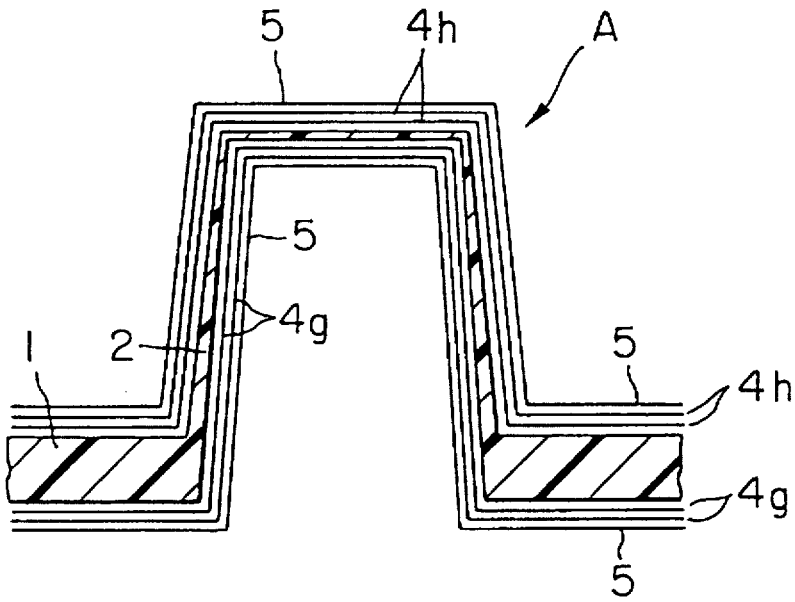

Next, even further embodiments will now be described with reference to FIG. 20 and FIG. 21. The embodiment shown in FIG. 20 combines the configurations of FIG. 8 and FIG. 12. In other words, double deposit layers 4*g* and 4*h* are respectively formed by the same means as described above over the entire inner and outer surface regions of each pocket-shaped molded portion 2, and then protective films 5 are formed by the same means as described above over the entire inner and outer surface regions of the thus-formed layers 4*g* and 4*h*. Similarly, the embodiment shown in FIG. 21 combines the configurations of FIG. 9 and FIG. 13. In other words, double deposit layers 4*g* and 4*h* are respectively formed by the same means as described above over the entire inner and outer surface regions of the thermoplastic synthetic resin molded sheet 1, including the pocket-shaped molded portions 2, and then protective films 5 are formed by the same means as described above over the entire inner and outer surface regions of the thus-formed layers 4*g* and 4*h*.

Permeability experiments were conducted to determine the effect of the present invention. Samples of the present invention were created by molding a 250-μm thick sheet of polypropylene to have pocket-shaped molded portions by a pneumatic plate type of PTP packager, depositing an approximately 500-Angstrom thick layer of a silicon oxide by vacuum deposition on the pocket-shaped molded portions as shown in either FIG. 6 or FIG. 10, inserting a previously dried sample of an object to be packaged, made of calcium chloride, into each pocket-shaped molded portion, and then heat sealing a sealing sheet formed of 20-μm thick aluminum foil to the molded sheet to form five PTPs. These samples were tested against comparative 5-packs comprising four combinations of polypropylene sheet A, B, C, and D of thicknesses of 250 to 300 μm with 20-μm thick aluminum foil, placed under conditions of a temperature of 40° C. and humidity of 90%, and the permeability comparisons were obtained by weighing to obtain the results listed in the following table:

TABLE

| Molded Sheet | Sealing Sheet | Water-Vapor Permeability (mg/day · pocket) |
|---|---|---|
| | COMPARATIVE PACKAGES | |
| Polyvinyl chloride (thickness: 200 μm) | Aluminum foil (thickness: 17 μm) | 4.62 (4.11 to 5.36) |
| Polypropylene A (thickness: 300 μm) | Aluminum foil (thickness: 20 μm) | 0.65 (0.56 to 0.72) |
| Polypropylene B (thickness: 300 μm) | Aluminum foil (thickness: 20 μm) | 0.70 (0.55 to 0.84) |
| Polypropylene C (thickness: 250 μm) | Aluminum foil (thickness: 20 μm) | 0.83 (0.66 to 0.98) |
| Polypropylene D (thickness: 250 μm) | Aluminum foil (thickness: 20 μm) | 0.96 (0.69 to 1.11) |
| | PRESENT INVENTION | |
| Polypropylene, as shown in FIG. 5 (thickness: 250 μm) | Aluminum foil (thickness: 20 μm) | 0.10 (0.05 to 0.13) |

As shown in the table above, the package of the present invention has a water-vapor permeability that is significantly lower than that of the prior art.

Note that, for the purpose of comparison, the weights of regulated samples were measured, the samples were packaged, then the samples were held at a temperature of 40° C. and humidity of 90% and the samples were weighed at regular intervals to determine their changes in weight. These weights were used to calculate a unit quoted in the table: "mg/day.pocket."

INDUSTRIAL APPLICABILITY

The above description of PTPs concerns their use as packaging means for a pharmaceutical in tablet or capsule form, but the present invention can also be applied as appropriate to packaging for chocolates and other candies, foodstuffs, and cosmetics.

We claim:

1. A method of manufacturing a package, comprising the steps of:

preparing a thermoplastic synthetic resin sheet;

providing an openable mold having mold elements;

placing said thermoplastic synthetic resin sheet in said mold;

forming within said mold at least one pocket-shaped molded portion in said thermoplastic synthetic resin sheet in such a manner that it protrudes outward from one surface thereof, and also forming within said mold and on the other surface of said thermoplastic synthetic resin sheet an opening for said pocket-shaped molded portion, to obtain a molded sheet, said pocket-shaped molded portion being caused to have inner and outer surfaces;

forming a deposit layer over at least one of said inner and outer surfaces of said pocket-shaped molded portion while said molded sheet is held on one of said mold elements and while the one element of the mold is cooled;

removing the molded sheet with said deposit layer thereon;

accommodating an object to be packaged within the pocket-shaped molded portion; and bonding a sealing sheet to said other surface of said molded sheet in such a manner as to seal said opening of said pocket-shaped molded portion.

2. A method of manufacturing a package according to claim 1, wherein an inorganic oxide is used as said deposit layer.

3. A method of manufacturing a package according to claim 1, wherein a silicon oxide is used as said deposit layer.

4. A method of manufacturing a package according to claim 1, wherein aluminum oxide is used as said deposit layer.

5. A method of manufacturing a package according to claim 1, wherein the process used to form said deposit layer is plasma deposition.

6. A method of manufacturing a package according to claim 1, wherein the process used to form said deposit layer is chemical vapor deposition.

7. A method of manufacturing a package according to claim 1, wherein the process used to form said deposit layer is applied in such a manner as to increase the thickness of thin portions created in the pocket-shaped molded portion by the stretching of the material thereof during the molding of the molded sheet.

* * * * *